US007131889B1

(12) United States Patent
Taylor

(10) Patent No.: US 7,131,889 B1
(45) Date of Patent: Nov. 7, 2006

(54) METHOD FOR PLANARIZING MICROELECTRONIC WORKPIECES

(75) Inventor: Theodore M. Taylor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 431 days.

(21) Appl. No.: 10/091,052

(22) Filed: Mar. 4, 2002

(51) Int. Cl.
*B24B 1/00* (2006.01)

(52) U.S. Cl. ..... 451/8; 451/41; 451/56; 451/443

(58) Field of Classification Search ..... 451/6, 451/5, 8, 36, 41, 56, 57, 59, 63, 65, 66, 72, 451/10, 259, 21, 443, 285–290
See application file for complete search history.

(56) References Cited

U.S. PATENT DOCUMENTS 5,036,015 A 7/1991 Sandhu et al.
5,069,002 A 12/1991 Sandhu et al.
5,081,796 A 1/1992 Schultz
5,222,329 A 6/1993 Yu
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,413,941 A 5/1995 Koos et al.
5,421,769 A 6/1995 Schultz et al.
5,433,651 A 7/1995 Lustig et al.
5,439,551 A 8/1995 Meikle et al.
5,449,314 A 9/1995 Meikle et al.
5,486,129 A 1/1996 Sandhu et al.
5,514,245 A 5/1996 Doan et al.
5,533,924 A 7/1996 Stroupe et al.
5,540,810 A 7/1996 Sandhu et al.
5,609,718 A 3/1997 Meikle
5,618,381 A 4/1997 Doan et al.
5,618,447 A 4/1997 Sandhu
5,643,048 A 7/1997 Iyer
5,643,060 A 7/1997 Sandhu et al.
5,658,183 A 8/1997 Sandhu et al.
5,658,190 A 8/1997 Wright et al.
5,663,797 A 9/1997 Sandhu
5,664,988 A 9/1997 Stroupe et al.
5,679,065 A 10/1997 Henderson
5,700,180 A 12/1997 Sandhu et al.
5,702,292 A 12/1997 Brunelli et al.

(Continued)

OTHER PUBLICATIONS

Seiichi Kondo, Noriyuki Sakuma, Yoshio Homma, Yasushi Goto, Naofumi Ohashi, Hizuru Yamaguchi, and Nobuo Owada, "Abrasive-Free Polishing for Copper Damascene Interconnection", *Journal of the Electrochemical Society,* 147 (10) pp. 3907-3913 (2000).

*Primary Examiner*—Joseph J. Hail, III
*Assistant Examiner*—Anthony Ojini
(74) *Attorney, Agent, or Firm*—Perkins Coie LLP

(57) ABSTRACT

Planarizing machines and methods for accurately planarizing microelectronic workpieces. Several embodiments of the planarizing machines produce a planar surface at a desired endpoint in the microelectronic workpieces by (a) quickly reducing variances on the surface of the workpiece using a planarizing medium that removes topographical features but has a low polishing rate on planar surfaces; and (b) subsequently planarizing the wafer on a planarizing medium that has a higher polishing rate on planar surfaces than the first polishing medium.

27 Claims, 4 Drawing Sheets

U.S. PATENT DOCUMENTS 5,730,642 A 3/1998 Sandhu et al.
5,738,562 A 4/1998 Doan et al.
5,747,386 A 5/1998 Moore
5,777,739 A 7/1998 Sandhu et al.
5,792,709 A 8/1998 Robinson et al.
5,795,495 A 8/1998 Meikle
5,798,302 A 8/1998 Hudson et al.
5,807,165 A 9/1998 Uzoh et al.
5,816,891 A * 10/1998 Woo ..... 451/6
5,830,806 A 11/1998 Hudson et al.
5,842,909 A 12/1998 Sandhu et al.
5,851,135 A 12/1998 Sandhu et al.
5,855,804 A 1/1999 Walker
5,868,896 A 2/1999 Robinson et al.
5,882,248 A 3/1999 Wright et al.
5,893,754 A 4/1999 Robinson et al.
5,895,550 A 4/1999 Andeas
5,897,426 A * 4/1999 Somekh ..... 451/41
5,910,846 A 6/1999 Sandhu
5,930,699 A 7/1999 Bhatia
5,934,980 A 8/1999 Koos et al.
5,936,733 A 8/1999 Sandhu et al.
5,945,347 A 8/1999 Wright
5,954,912 A 9/1999 Moore
5,967,030 A 10/1999 Blalock
5,972,792 A 10/1999 Hudson
5,980,363 A 11/1999 Meikle et al.
5,981,396 A 11/1999 Robinson et al.
5,994,224 A 11/1999 Sandhu et al.
5,997,384 A 12/1999 Blalock
6,007,408 A 12/1999 Sandhu
6,039,633 A 3/2000 Chopra
6,040,245 A 3/2000 Sandhu et al.
6,046,111 A 4/2000 Robinson
6,054,015 A 4/2000 Brunelli et al.
6,057,602 A 5/2000 Hudson et al.
6,066,030 A 5/2000 Uzoh
6,074,286 A 6/2000 Ball
6,083,085 A 7/2000 Lankford
6,108,092 A 8/2000 Sandhu
6,110,820 A 8/2000 Sandhu et al.
6,116,988 A 9/2000 Ball
6,120,354 A 9/2000 Koos et al.
6,135,856 A 10/2000 Tjaden et al.
6,139,402 A 10/2000 Moore
6,143,123 A 11/2000 Robinson et al.
6,143,155 A 11/2000 Adams et al.
6,152,808 A 11/2000 Moore
6,176,992 B1 1/2001 Talieh
6,180,525 B1 1/2001 Morgan
6,184,571 B1 2/2001 Moore
6,187,681 B1 2/2001 Moore
6,190,494 B1 2/2001 Dow
6,191,037 B1 2/2001 Robinson et al.
6,191,864 B1 2/2001 Sandhu
6,193,588 B1 2/2001 Carlson
6,200,901 B1 3/2001 Hudson et al.
6,203,404 B1 3/2001 Joslyn et al.
6,203,407 B1 3/2001 Robinson
6,203,413 B1 3/2001 Skrovan
6,206,754 B1 3/2001 Moore
6,206,756 B1 3/2001 Chopra et al.
6,206,769 B1 3/2001 Walker
6,208,425 B1 3/2001 Sandhu et al.
6,210,257 B1 4/2001 Carlson
6,213,845 B1 4/2001 Elledge
6,218,316 B1 4/2001 Marsh
6,224,466 B1 5/2001 Walker et al.
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,250,994 B1 6/2001 Chopra et al.
6,251,785 B1 6/2001 Wright
6,261,151 B1 7/2001 Sandhu et al.
6,261,163 B1 7/2001 Walker et al.
6,267,650 B1 7/2001 Hembree
6,273,786 B1 8/2001 Chopra et al.
6,273,796 B1 8/2001 Moore
6,276,996 B1 8/2001 Chopra
6,284,660 B1 9/2001 Doan
6,287,172 B1 * 9/2001 Kuan et al. ..... 451/41
6,287,879 B1 9/2001 Gonzales et al.
6,290,572 B1 9/2001 Hofmann
6,301,006 B1 10/2001 Doan
6,306,012 B1 10/2001 Sabde
6,306,014 B1 10/2001 Walker et al.
6,306,768 B1 10/2001 Klein
6,312,558 B1 11/2001 Moore
6,313,038 B1 11/2001 Chopra et al.
6,319,420 B1 11/2001 Dow
6,323,046 B1 11/2001 Agarwal
6,328,632 B1 12/2001 Chopra
6,331,488 B1 12/2001 Doan et al.
6,338,667 B1 1/2002 Sandhu et al.
6,340,327 B1 * 1/2002 Afif ..... 451/444
6,350,180 B1 2/2002 Southwick
6,350,691 B1 2/2002 Lankford
6,352,466 B1 3/2002 Moore
6,354,923 B1 3/2002 Lankford
6,354,930 B1 3/2002 Moore
6,358,122 B1 3/2002 Sabde et al.
6,358,127 B1 3/2002 Carlson et al.
6,358,129 B1 3/2002 Dow
6,361,417 B1 3/2002 Walker et al.
6,362,105 B1 3/2002 Moore
6,364,746 B1 4/2002 Moore
6,364,757 B1 4/2002 Moore
6,368,190 B1 4/2002 Easter et al.
6,368,193 B1 4/2002 Carlson et al.
6,368,194 B1 4/2002 Sharples et al.
6,368,197 B1 4/2002 Elledge
6,376,381 B1 4/2002 Sabde
6,390,902 B1 * 5/2002 Chang et al. ..... 451/285
6,413,156 B1 * 7/2002 Shimizu et al. ..... 451/287
6,431,949 B1 * 8/2002 Ishikawa et al. ..... 451/5
6,435,942 B1 * 8/2002 Jin et al. ..... 451/8

* cited by examiner

METHOD FOR PLANARIZING MICROELECTRONIC WORKPIECES

TECHNICAL FIELD

The present disclosure relates to planarizing microelectronic workpieces using chemical-mechanical planarization or mechanical planarization in the fabrication of microelectronic devices. Although the present invention is related to planarizing many different types of microelectronic workpieces, the following disclosure describes particular aspects with respect to forming Shallow Trench Isolation (STI) structures.

BACKGROUND

Mechanical and chemical-mechanical planarizing processes (collectively "CMP") remove material from the surface of semiconductor wafers, field emission displays or other microelectronic substrates in the production of microelectronic devices and other products. FIG. 1 schematically illustrates a CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a substrate 12 may be attached, or the substrate 12 may be attached to a resilient pad 34 in the head 32. The head 32 may be a free-floating wafer carrier, or an actuator assembly 36 may be coupled to the head 32 to impart axial and/or rotational motion to the substrate 12 (indicated by arrows H and I, respectively).

The planarizing pad 40 and a planarizing solution 44 on the pad 40 collectively define a planarizing medium that mechanically and/or chemically removes material from the surface of the substrate 12. The planarizing pad 40 can be a soft pad or a hard pad. The planarizing pad 40 can also be a fixed-abrasive planarizing pad in which abrasive particles are fixedly bonded to a suspension material. In fixed-abrasive applications, the planarizing solution 44 is typically a non-abrasive "clean solution" without abrasive particles. In other applications, the planarizing pad 40 can be a non-abrasive pad composed of a polymeric material (e.g., polyurethane), resin, felt or other suitable materials. The planarizing solutions 44 used with the non-abrasive planarizing pads are typically abrasive slurries with abrasive particles suspended in a liquid.

To planarize the substrate 12 with the CMP machine 10, the carrier assembly 30 presses the substrate 12 face-downward against the polishing medium. More specifically, the carrier assembly 30 generally presses the substrate 12 against the planarizing liquid 44 on a planarizing surface 42 of the planarizing pad 40, and the platen 20 and/or the carrier assembly 30 move to rub the substrate 12 against the planarizing surface 42. As the substrate 12 rubs against the planarizing surface 42, material is removed from the face of the substrate 12.

CMP processes should consistently and accurately produce a uniformly planar surface on the substrate to enable precise fabrication of circuits and photo-patterns. During the construction of transistors, contacts, interconnects and other features, many substrates develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a substrate.

In the highly competitive semiconductor industry, it is also desirable to maximize the throughput of CMP processing by producing a planar surface on a substrate as quickly as possible. The throughput of CMP processing is a function, at least in part, of the polishing rate of the substrate assembly and the ability to accurately stop CMP processing at a desired endpoint. Therefore, it is generally desirable for CMP processes to provide a controlled polishing rate (a) across the face of a substrate to enhance the planarity of the finished substrate surface, and (b) during a planarizing cycle to enhance the accuracy of determining the endpoint of a planarizing cycle.

One concern of CMP processing is that it is difficult to control the polishing rate. The polishing rate typically varies across the surface of the workpiece or during a planarizing cycle because (a) topographical areas with high densities of small features may polish faster than flat peripheral areas, (b) the distribution of abrasive particles in the slurry varies across the face of the workpiece, (c) velocity and thermal gradients vary across the surface of the workpiece, (d) the condition of the surface of the planarizing pad varies, (e) the topography of the workpiece changes, and (f) several other factors. The variance in the polishing rate may not be uniform across the workpiece, and thus it may cause different areas on the workpiece to reach the endpoint at different times. This produces over-polishing in areas with high polishing rates, and under-polishing in other areas with lower polishing rates.

The variance in the polishing rate can be particularly difficult to control when slurries with very small abrasive particles are used on wafers with a high density of small features. It is becoming increasingly important to use very small abrasive particles in CMP slurries because the feature sizes of the microelectronic components are decreasing to produce high performance/capacity products, and the small particle sizes enable mechanical removal of material from workpieces without damaging or otherwise impairing the small components. The slurries with small particle sizes, however, may produce different results as the surface of the planarizing pad changes throughout a run of workpieces, or even during a single planarizing cycle of one workpiece. This can produce inconsistent results that reduce the reliability of CMP processing. Therefore, there is a strong need to provide a planarizing process that can accurately endpoint a planarizing cycle without significantly increasing the time to planarize each workpiece.

DETAILED DESCRIPTION

The following disclosure describes several planarizing machines and methods for accurately planarizing microelectronic workpieces. Several embodiments of the planarizing machines produce a planar surface at a desired endpoint in the microelectronic workpieces by (a) initially removing material from the surface of the workpiece using a first planarizing medium that quickly removes topographical features but has a low polishing rate on planar surfaces; and (b) subsequently removing material from the surface of the workpiece using a second planarizing medium that has a higher polishing rate on planar surfaces than the first polishing medium. Several embodiments of the following planarizing machines and methods for planarizing microelectronic workpieces accordingly form a planar surface across a workpiece at a desired endpoint in a relatively short period of time. FIGS. 2–5 illustrate several embodiments of planarizing machines and methods in accordance with the invention, and like reference numbers refer to like components throughout these figures. Many specific details of certain embodiments of the invention are set forth in the following description and FIGS. 2–5 to provide a thorough understanding of such embodiments. A person skilled in the art will thus understand that the invention may have additional embodiments, or that the invention may be practiced without several of the details described below.

Figure 2:
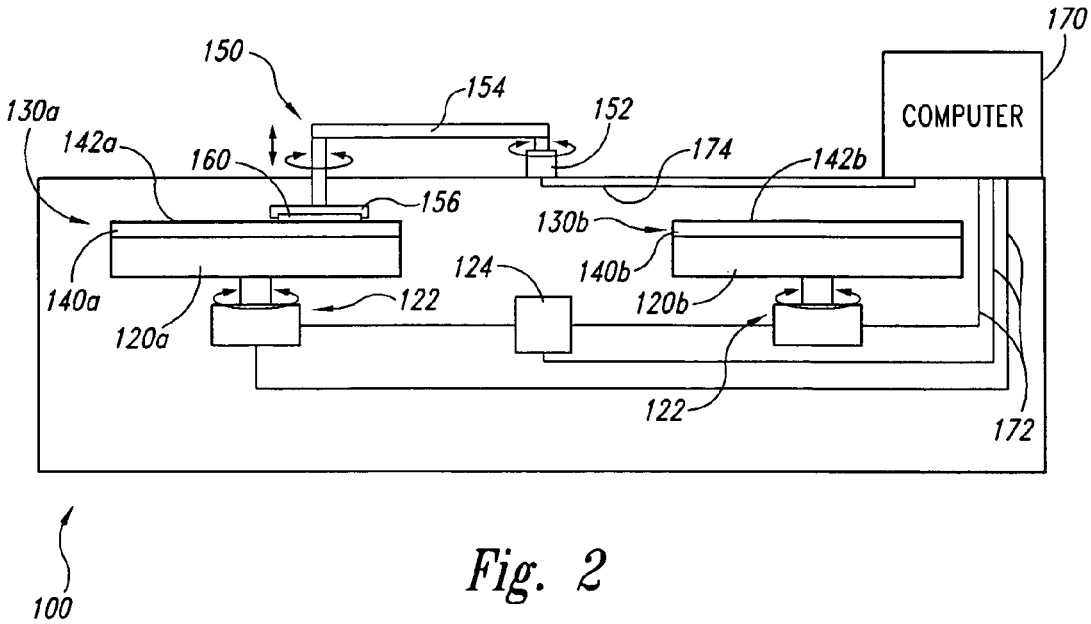
FIG. 2 is a schematic cross-sectional view of a planarizing machine in accordance with an embodiment of the invention.

FIG. 2 is a schematic view of a planarizing machine 100 in accordance with one embodiment of the invention. In this embodiment, the planarizing machine 100 includes a first plate 120*a*, a second plate 120*b*, and a separate drive system 122 coupled to each of the plates 120*a*–*b*. The plates 120*a*–*b* can be separate platens, and each drive system 122 can independently rotate the plates 120*a*–*b*. The drive systems 122 can be coupled to a monitor 124 that senses the loads on each drive system 122. The monitor 124, for example, can be a current meter that measures the electrical current drawn by motors in the drive systems 122. As explained in more detail below, the monitor 124 is used to estimate the status of the surface of a workpiece being planarized on the planarizing machine 100.

The planarizing machine 100 can also include a first planarizing medium 130*a* and a second planarizing medium 130*b*. The first planarizing medium can include a first pad 140*a* on the first plate 120*a*. The first pad 140*a* has a first planarizing surface 142*a* upon which an abrasive planarizing slurry (not shown in FIG. 2) is disposed. The second planarizing medium 130*b* includes a second pad 140*b* on the second plate 120*b*. The second pad 140*b* can have a second planarizing surface 142*b* upon which the same planarizing slurry or another abrasive planarizing slurry is disposed. The first planarizing surface 142*a* has a first roughness, and the second planarizing surface 142*b* has a second roughness. The first roughness of the first planarizing surface 142*a* is greater than the second roughness of the second planarizing surface 142*b*. The first planarizing surface 142*a*, for example, can have a first texture and the second planarizing surface 142*b* can have a second texture such that the second planarizing surface 142*b* removes material from a planar surface of a microelectronic workpiece faster than the first planarizing surface 142*a*. As explained in more detail below, the different textures or roughnesses between the first and second planarizing surfaces 142*a* and 142*b* enables the planarizing machine to more effectively remove material from a workpiece in a controlled manner at different stages of a planarizing cycle.

The planarizing machine 100 can also include a workpiece carrier 150 having a drive mechanism 152, an arm 154 coupled to the drive mechanism 152, and a holder 156 carried by the arm 154. The holder 156 is configured to hold and protect a microelectronic workpiece 160 during a planarizing cycle. The workpiece carrier 150 can accordingly rotate the arm 154 to position the holder 156 at either the first pad 140*a* or the second pad 140*b*. Additionally, the workpiece carrier 150 can raise/lower or rotate the holder 156 to impart the desired relative motion between the workpiece 160 and the planarizing media 130*a* and 130*b*. Suitable workpiece carriers 150 are used in existing rotary CMP machines manufactured by Applied Materials, Incorporated.

The planarizing machine 100 can further include a computer 170 that is operatively coupled to the drive systems 122 and the monitor 124 by lines 172, and operatively coupled to the workpiece carrier 150 by a line 174. The computer 170 contains a computer-readable medium, such as software or hardware, that executes instructions to carry out a number of different methods for planarizing a workpiece 160 on the first planarizing medium 130*a* during a first abrasive stage of a planarizing cycle and then the second planarizing medium 130*b* during a second abrasive stage of the planarizing cycle. In general, the computer 170 causes the workpiece carrier 150 to press the workpiece 160 against the first planarizing surface 142*a* and a slurry containing abrasive particles during the first abrasive stage of the planarizing cycle, and then move the workpiece 160 and press it against the second planarizing surface 142*b* in the presence of a slurry containing abrasive particles during the second abrasive stage of the planarizing cycle. The first abrasive stage of the planarizing cycle can be used to remove topographical features on the surface of the workpiece 160 in a manner that forms a surface that is at least approximately planar, and then the second abrasive stage of the planarizing cycle can be used to remove material from a planar surface on the workpiece 160 at a higher polishing rate than the polishing rate of the first planarizing medium 130*a*. It will be appreciated that the computer 170 can contain instructions to perform several different types of methods using the abrasive planarizing media 130*a* and 130*b* in accordance with several different embodiments of the present invention.

FIGS. 3A–3D illustrate progressive stages of planarizing a microelectronic workpiece 160 in accordance with an embodiment of a method of the invention. Several embodiments of the planarizing machine 100 described above with reference to FIG. 2 can be used to planarize the microelectronic workpiece 160 in accordance with this method. It will be appreciated, however, that the planarizing machine 100 can be used to planarize microelectronic workpieces using methods in accordance with other embodiments of the invention. The methods described below with reference to FIGS. 3A–3D can also be performed using alternate embodiments of planarizing machines in accordance with the invention described with reference to FIGS. 4 and 5.

Figure 3A:
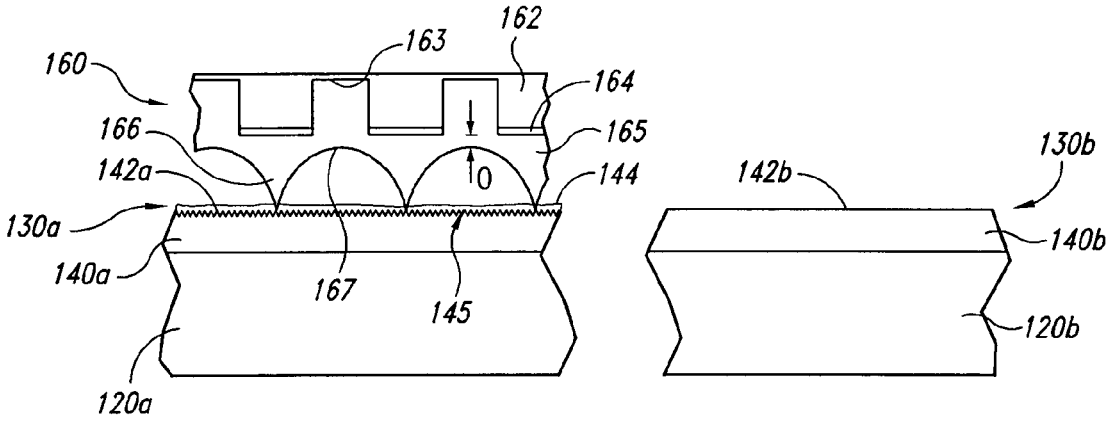
FIGS. 3A–3D are cross-sectional views showing a portion of a planarizing machine and a microelectronic workpiece at various stages of a planarizing cycle in accordance with a method of the invention.

FIG. 3A illustrates the microelectronic workpiece 160 at an initial period of a first abrasive stage of a planarizing cycle. The microelectronic workpiece 160 shown in FIG. 3A has a Shallow Trench Isolation (STI) structure including a substrate 162, a plurality of trenches 163 in the substrate 162, a polish-stop layer 164 on the top surfaces of the substrate 162, and a fill layer or cover layer 165. The fill layer 165 typically has a plurality of high points or peaks 166 over the segments of the polish-stop layer 164 and a plurality of troughs 167 over the trenches 163. During the initial period of the first abrasive stage, the method includes removing material from the microelectronic workpiece 160 by pressing the workpiece 160 against the first planarizing surface 142*a* and an abrasive slurry 144 on the first planarizing surface 142*a*. The abrasive slurry 144, for example, can include a liquid solution and a plurality of small abrasive particles 145. The abrasive particles 145 can be particles of ceria, alumina, titania or other materials having an average particle size of approximately 0.1–100 nm. It will be appreciated that other types of particles having other particles sizes can be used as well in accordance with other embodiments of the invention. The first surface 142*a* has a texture defining a first roughness that is relatively high compared to the second surface 142*b* of the second pad 140*b*. The first surface 142*a* and the abrasive slurry 144 work together to remove the peaks 166 rather quickly. The removal of the peaks 166 accordingly reduces the topographical variances across the surface of the workpiece 160 until the planarizing surface 142*a* begins to engage the troughs 167. At this point, the planarizing surface 142*a* begins to remove material from an over-burden region "O" of the fill layer 165.

Figure 3B:
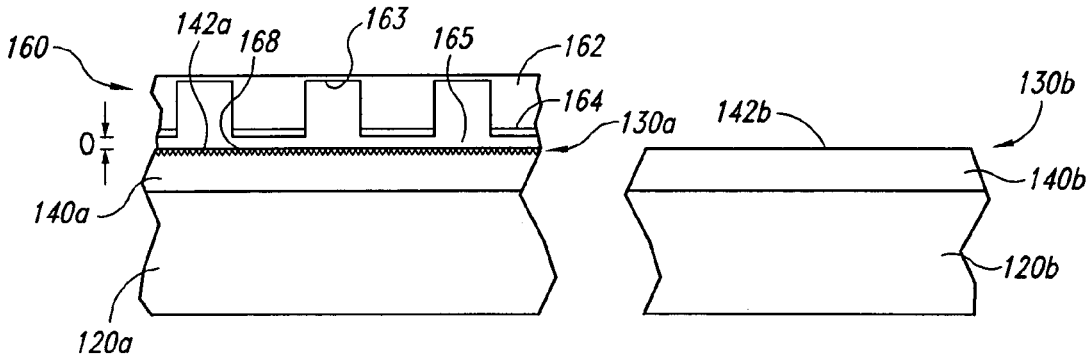

FIG. 3B illustrates a subsequent period of the first abrasive stage of a method for planarizing the workpiece 160. At this period, the peaks 166 (FIG. 3A) have been removed such that the fill layer 165 has a intermediate surface 168 that is in the overburden region O. The intermediate surface 168 is generally at least approximately planar at this period of the first abrasive stage. The inventors have discovered that the combination of the relatively rough first planarizing surface 142*a* and the abrasive slurry 144 having small abrasive particles has a very low polishing rate on the substantially planar intermediate surface 168. The polishing rate can be low enough such that the intermediate surface 168 acts as a virtual polish-stop surface in the overburden region O when it becomes planar or nearly planar.

Figure 1:
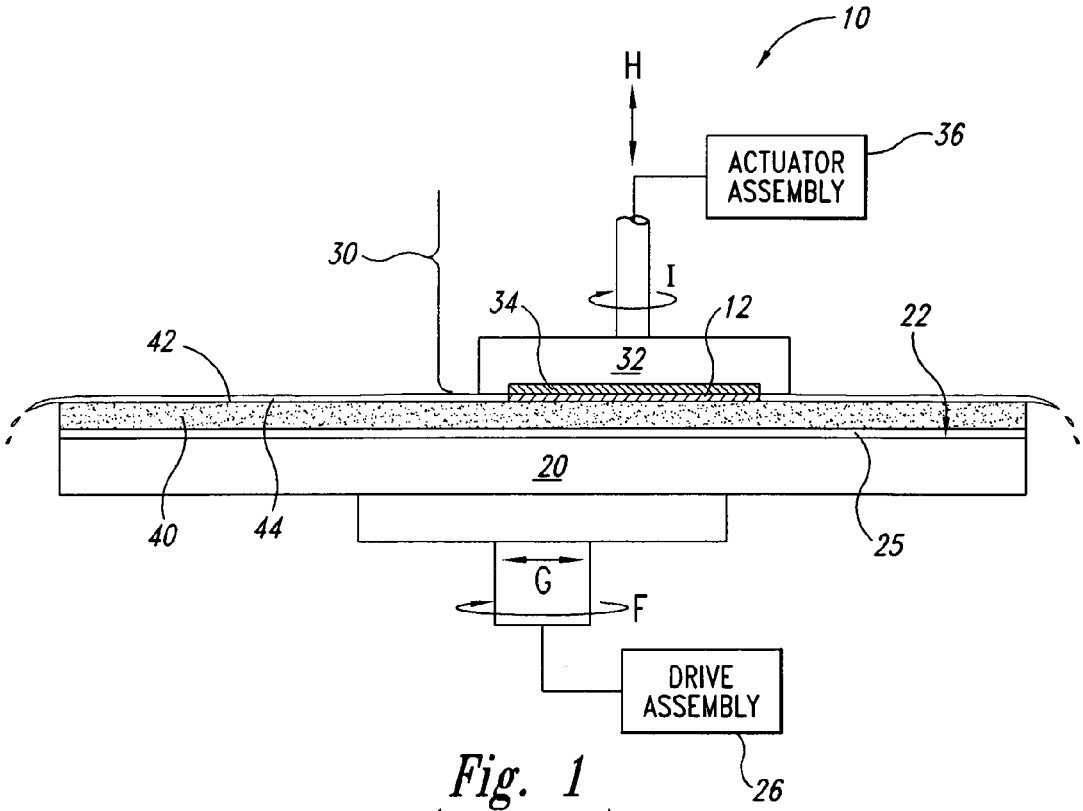
Fig. 1 (Prior Art)
FIG. 1 is a schematic cross-sectional view of a planarizing machine in accordance with the prior art.

The termination of the first abrasive stage shown in FIG. 3B can be identified by the monitor 124 (FIG. 2) and the computer 170 (FIG. 2). The onset of planarity typically causes an increase in the drag force exerted by the workpiece 160 against the first pad 140*a*. The increase in drag force increases the load on the drive system 122 (FIG. 1), which causes the drive system 122 to draw more electricity to operate the motor that rotates the plate 120*a*. The monitor 124 measures such an increase in the current draw and sends a signal to the computer 170. When the current draw reaches a predetermined level or increases in a predetermined manner, the computer 170 indicates that the intermediate surface 168 of the workpiece 160 is at least approximately planar in the overburden region O.

Figure 3C:
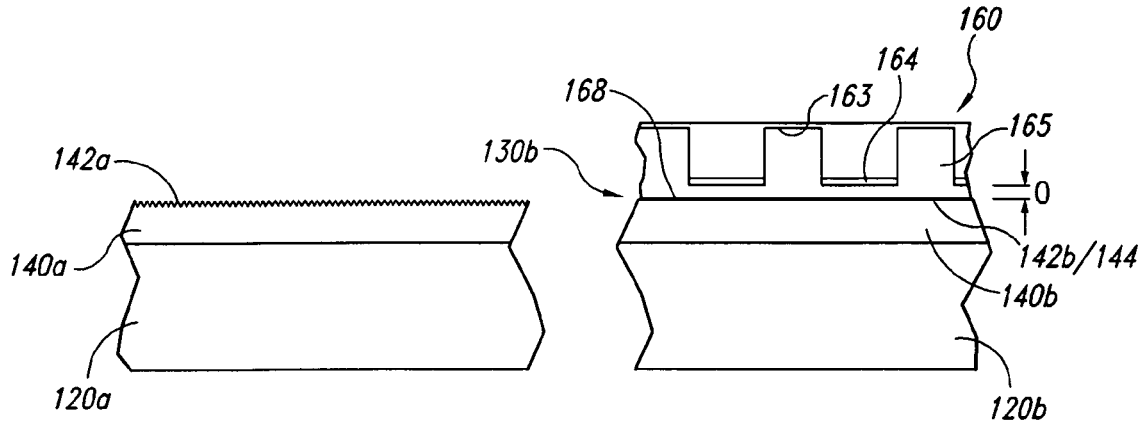

FIG. 3C illustrates an initial period of a second abrasive stage for planarizing the workpiece 160 using the planarizing machine 100. At the initial period of the second abrasive stage, the method includes removing additional material from the workpiece 160 by pressing the workpiece 160 against the second planarizing surface 142*b* and an abrasive slurry 144. The second planarizing surface 142*b* has a second roughness that is less than the first roughness of the first planarizing surface 142*a*. The "smoother" second planarizing surface 142*b* and the abrasive slurry 144 (not shown in FIG. 3C) operate together to have a higher polishing rate on the substantially planar intermediate surface 168 than the polishing rate of the first planarizing surface 142*a*. The second abrasive stage of the planarizing cycle accordingly removes the material in the overburden region O of the fill layer 165 at an adequate polishing rate to enhance the throughput of the planarizing cycle.

Figure 3D:
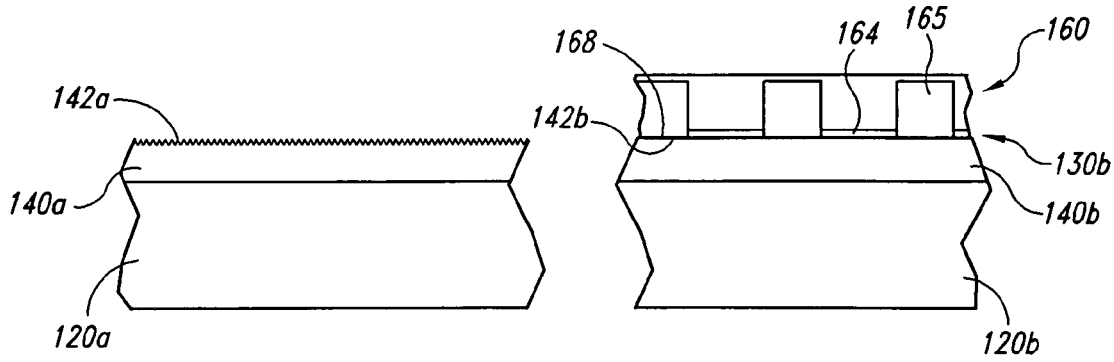

FIG. 3D illustrates a subsequent period of the second abrasive stage at which the polish-stop layer 164 endpoints the planarizing cycle. The polish-stop layer 164 has a much lower polishing rate than the fill layer 165, and thus the polish-stop layer 164 inhibits further removal of material from the workpiece. The polish-stop layer 164, for example, can be a silicone nitride layer ($Si_3N_4$) and the fill layer 165 can be a silicone oxide.

The planarizing machine 100 can sense the endpoint of the planarizing cycle based on the different coefficients of friction between the polish-stop layer 164 and the fill layer 165. The drag force between the workpiece 160 and the second pad 140*b* accordingly changes as the polish-stop layer 164 is exposed to the second planarizing surface 142*b*. The monitor 124 can sense such a change in the drag force between the workpiece 160 and the pad 140*b* at the onset of the endpoint, and then computer 170 can terminate the planarizing cycle when the signal from the monitor 124 indicates that the surface of the workpiece is within the polish-stop layer 164.

Several embodiments of the planarizing machine 100 and the method shown in FIGS. 2–3D are expected to provide a uniform surface across the face of a workpiece at a desired endpoint without over-polishing or under-polishing. By using a rough planarizing surface for the first abrasive stage, the planarizing cycle can quickly remove the topographical features to an intermediate surface in the overburden region O of the workpiece. The removal rate of the topographical features using the rough first planarizing surface is generally about as fast as removing the features with a smooth planarizing surface. However, when the intermediate surface of the workpiece is at least substantially planar, the polishing rate drops significantly using the rough planarizing medium. This allows the planar regions of the workpiece to planarize at a slower polishing rate than the topographical regions so that a planar surface is formed on the substrate in the overburden region O without over- or under-polishing particular regions of the workpiece. The second abrasive stage of the planarizing cycle is used to more effectively remove the material from the planar surface in the overburden region O. This is possible because the lower degree roughness of the second planarizing surface actually has a higher polishing rate on planar workpiece surfaces using an abrasive slurry than does the higher roughness of the first planarizing surface. The endpoint can accordingly be accurately achieved by noting the exposure of the polish-stop layer. Therefore, several embodiments of the planarizing machine 100 and methods described above with reference to FIGS. 2–3D not only form a planar surface at an accurate endpoint, but they do so in a manner that reduces the overall time for a planarizing cycle to enhance the throughput of planarized workpieces.

Figure 4:
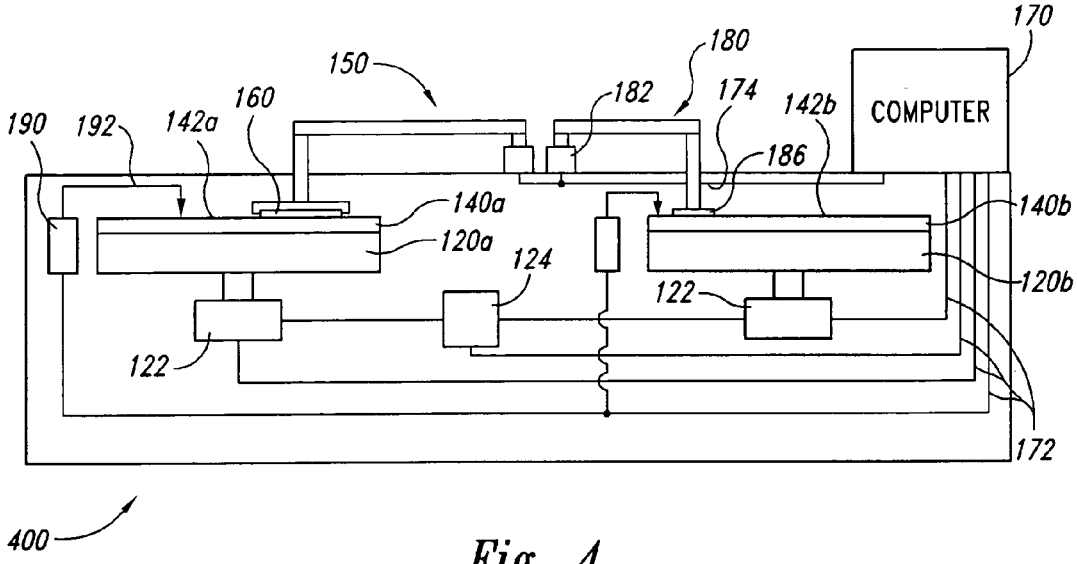
FIG. 4 is a schematic cross-sectional view of a planarizing machine in accordance with another embodiment of the invention.

FIG. 4 is a schematic view of a planarizing machine 400 in accordance with another embodiment of the invention. The planarizing machine 400 has several similar components to the planarizing machine 100 described above with reference to FIG. 2, and thus like reference numbers refer to like components in FIGS. 2 and 4. In addition to the components of the planarizing machine 100 shown in FIG. 2, the planarizing machine 400 includes a conditioner system 180 and a pad monitor 190. The conditioner system 180 can include a drive system 182, an arm 184 coupled to the drive system 182, and an end effector 186 carried by the arm 184. The end effector 186 roughens or otherwise alters the planarizing surfaces 142*a* or 142*b* to impart the desired surface condition to the pads 140*a–b*.

The planarizing machine 400 provides the desired surface roughness or other condition to the planarizing surfaces 142*a–b*. In general, the computer 170 controls the drive system 182 to selectively press the end effector 186 against the pads 140*a–b*. The time, downforce, movement and end-effector type can be selected to produce a desired surface condition on the pads 140*a–b*. For example, a higher downforce can be used to provide a rougher surface on the pads. The computer 170 can accordingly cause the drive system 182 to press the end effector 186 against the first planarizing surface 142*a* at one downforce and then press the end effector 186 against the second planarizing surface 142*b* at a lower downforce so that the first roughness of the first surface 142*a* is greater than the second roughness of the second surface 142*b*. The pad monitor 190 for each pad can include a sensor 192 that provides an indication of the surface condition of the planarizing surfaces 142*a–b*. The sensor 192 can be a stylus that measures the profile of the planarizing surfaces 142*a–b*, or the sensor 192 can be an optical sensor that optically determines the roughness or other surface condition of the pads 140*a–b*.

The planarizing machine 400 can perform a method in which the conditioning system 180 conditions the first pad 140*a* such that the first planarizing surface 142*a* has the first roughness, and then condition the second pad 140*b* so that the second planarizing surface 142*b* has the second roughness. The particular downforce that is used to impart the first and second roughnesses to the pads 140*a–b* can be determined by the pad monitors 190. For example, if the pad monitor 190 for the first pad 140*a* notes that the first surface 142*a* has a roughness within a desired range for the first roughness, then it can indicate that the conditioning system 180 does not need to condition the first pad 140*a*. On the other hand, if the pad monitor 190 indicates that the first planarizing surface 142*a* is substantially smooth, then it can set the downforce of the conditioning system 180 at a relatively high downforce level to impart the desired roughness to the first planarizing surface 142*a*. It will be appreciated that the conditioning system 180 can condition the entire planarizing surface of each pad 140*a*–140*b* according to the desired roughnesses, or that only selected regions identified by the pad monitors as being outside of a desired roughness can be conditioned by the conditioning system 180.

Figure 5:
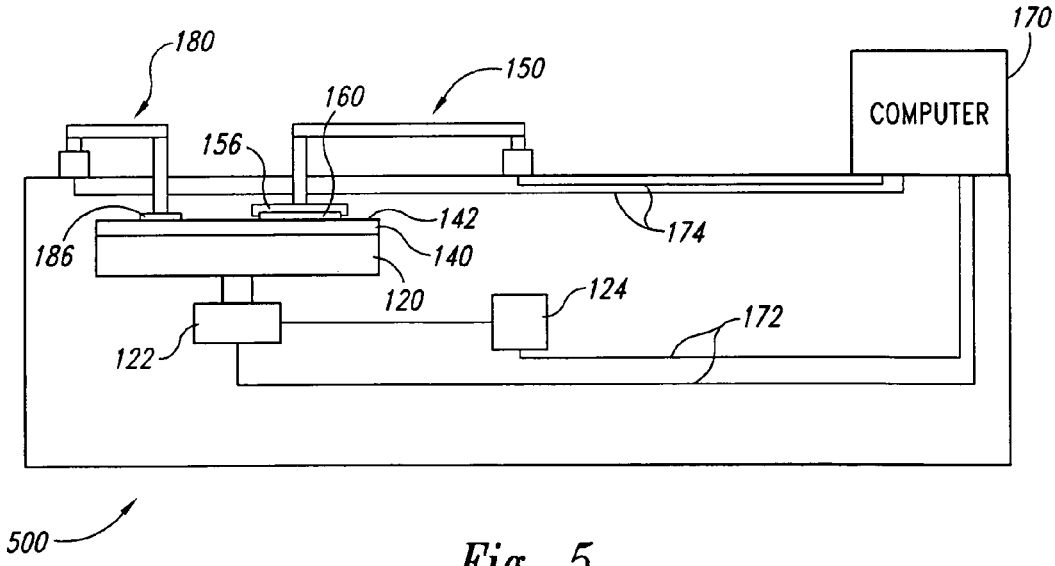
FIG. 5 is a schematic cross-sectional view of a planarizing machine in accordance with yet another embodiment of the invention.

FIG. 5 illustrates a planarizing machine 500 in accordance with another embodiment of the invention. In this embodiment, the planarizing machine 500 includes several components that are substantially similar to the planarizing machine 400 described above with reference to FIG. 4, but the planarizing machine 500 only includes a single plate 120 and a single pad 140. The pad 140 has a planarizing surface 142 that can be changed from a first planarizing surface having a first roughness to a second planarizing surface having a second roughness by the conditioning system 180. For example, the conditioning system 180 can press the end effector 186 against the planarizing surface 142 at a relatively high downforce to form a first planarizing surface having the first roughness. The carrier system 150 can then press the workpiece 160 against the first planarizing surface and an abrasive slurry during a first abrasive stage of the planarizing cycle. After the surface of the workpiece has become at least substantially planar as shown above with reference to FIG. 3B, the conditioning system 180 can re-condition the planarizing surface 142 so that it is smoother and has a second roughness less than the first roughness. The reconditioned planarizing surface of the pad 140 can define the second planarizing surface. The carrier system 150 can accordingly press the workpiece 160 against the second planarizing surface in a second abrasive stage of the planarizing cycle. As a result, the workpiece 160 can initially be planarized against a rough planarizing surface during the first abrasive stage to remove topography from the surface of the workpiece 160, the pad 140 can be conditioned to provide a smoother planarizing surface, and then the smoother second planarizing surface of the same pad 140 can be used to remove the overburden region O of the fill layer at a faster polishing rate to reach the final endpoint.

From the foregoing, it will be appreciated that specific embodiments of the invention have been described herein for purposes of illustration, but that various modifications may be made without deviating from the spirit and scope of the invention. For example, the plates 120 can be stationary and the current monitor can be coupled to the drive system for the workpiece carrier to detect the onset of planarity and the endpoint. Accordingly, the invention is not limited except as by the appended claims.

What is claimed is:

1. A method for planarizing a microelectronic workpiece, comprising:

removing material from a microelectronic workpiece during a first abrasive stage of a planarizing cycle by pressing the workpiece against a first planarizing surface having a first roughness and an abrasive slurry on the first planarizing surface, wherein the first planarizing surface is on a first type of planarizing media;

terminating the first abrasive stage when a cover layer on a face of the workpiece is at least substantially planar at an elevation in an overburden portion of the cover layer;

removing additional material from the workpiece during a second abrasive stage of the planarizing cycle by pressing the workpiece against a second planarizing surface having a second roughness and an abrasive slurry on the second planarizing surface, wherein the second planarizing surface is on the first type of planarizing media, and wherein the first roughness is greater than the second roughness, the second abrasive stage commencing after terminating the first abrasive stage; and terminating the second abrasive stage at a desired endpoint.

2. The method of claim 1 wherein:

removing material from a microelectronic workpiece comprises providing a first plate and a first planarizing pad on the first plate, the first pad having a surface defining the first planarizing surface; and removing additional material from the workpiece comprises providing a second plate and a second planarizing pad on the second plate, the second pad having a surface defining the second planarizing surface, and the first and second pads being composed of the same material.

3. The method of claim 1 wherein:

removing material from a microelectronic workpiece comprises providing a first planarizing pad having a surface defining the first planarizing surface and conditioning the first planarizing surface to have the first roughness, wherein the first and second pads are composed of the same material; and removing additional material from the workpiece comprises providing a second planarizing pad having a surface defining the second planarizing surface and conditioning the second surface to have the second roughness.

4. The method of claim 1 wherein:

pressing the workpiece against the first planarizing surface comprises pressing the workpiece against a planarizing surface of a first pad on a first plate; and pressing the workpiece against the second planarizing surface comprises moving the workpiece away from the first pad and then pressing the workpiece against a planarizing surface of a second pad on a second plate.

5. The method of claim 1 wherein:

removing material from a microelectronic workpiece further comprises monitoring a drag force between the workpiece and the first planarizing surface and terminating the first abrasive stage when the drag force indicates that a cover layer on a face of the workpiece is at least substantially planar at an elevation in an overburden portion of the cover layer; and removing additional material from the workpiece comprises commencing the second abrasive stage after terminating the first abrasive stage, monitoring a drag force between the workpiece and the second planarizing surface, and terminating the second abrasive stage when the drag force indicates that the workpiece is at a desired endpoint.

6. The method of claim 1 wherein:

removing material from a microelectronic workpiece further comprises monitoring a drag force between the workpiece and the first planarizing surface; and terminating the first abrasive stage comprises terminating the first stage when the drag force indicates that a cover layer on a face of the workpiece is at least substantially planar at an elevation in an overburden portion of the cover layer.

7. The method of claim 1, further comprising:

sensing a surface condition of the first planarizing surface; and conditioning at least a portion of the first planarizing surface to have the first roughness according to the sensed surface condition of the first planarizing surface.

8. The method of claim 1, further comprising:

sensing a surface condition of the first and second planarizing surfaces;

conditioning at least a portion of the first planarizing surface to have the first roughness according to the sensed condition of the first planarizing surface; and conditioning at least a portion of the second planarizing surface to have the second roughness according to the sensed condition of the second planarizing surface.

9. The method of claim 1, further comprising:

providing a single planarizing pad;

conditioning the single planarizing pad to have a planarizing surface with the first roughness to define the first planarizing surface for the first abrasive stage; and reconditioning the planarizing surface of the single pad to have the second roughness to define the second planarizing surface for the second abrasive stage.

10. A method of planarizing a microelectronic workpiece, comprising:

removing a first portion of a cover layer of material on a microelectronic workpiece during a first abrasive stage of a planarizing cycle by pressing the workpiece against a first planarizing surface having a first roughness and an abrasive slurry on the first planarizing surface, wherein an overburden portion of the cover layer of material is left remaining on the workpiece at the end of the first stage;

terminating the first abrasive stage when the cover layer is at least substantially planar at an elevation in the overburden portion of the cover layer; and removing the overburden portion of material from the cover layer on the workpiece during a second abrasive stage of the planarizing cycle by pressing the workpiece against a second planarizing surface having a second roughness and an abrasive slurry on the second planarizing surface, wherein the first roughness is greater than the second roughness, the second abrasive stage commencing after terminating the first abrasive stage; and terminating the second abrasive stage at a desired endpoint.

11. The method of claim 10 wherein:

removing material from a microelectronic workpiece comprises providing a first plate and a first planarizing pad on the first plate, the first pad having a surface defining the first planarizing surface; and removing additional material from the workpiece comprises providing a second plate and a second planarizing pad on the second plate, the second pad having a surface defining the second planarizing surface.

12. The method of claim 10 wherein:

removing material from a microelectronic workpiece comprises providing a first planarizing pad having a surface defining the first planarizing surface and conditioning the first planarizing surface to have the first roughness; and removing additional material from the workpiece comprises providing a second planarizing pad having a surface defining the second planarizing surface and conditioning the second surface to have the second roughness.

13. The method of claim 10 wherein:

pressing the workpiece against the first planarizing surface comprises pressing the workpiece against a planarizing surface of a first pad on a first plate; and pressing the workpiece against the second planarizing surface comprises moving the workpiece away from the first pad and then pressing the workpiece against a planarizing surface of a second pad on a second plate.

14. The method of claim 10 wherein:

removing material from a microelectronic workpiece further comprises monitoring a drag force between the workpiece and the first planarizing surface and terminating the first abrasive stage when the drag force indicates that the cover layer is at least substantially planar at an elevation in the overburden portion of the cover layer; and removing additional material from the workpiece comprises commencing the second abrasive stage after terminating the first abrasive stage, monitoring a drag force between the workpiece and the second planarizing surface, and terminating the second abrasive stage when the drag force indicates that the workpiece is at a desired endpoint.

15. The method of claim 10 wherein removing material from a microelectronic workpiece further comprises:

monitoring a drag force between the workpiece and the first planarizing surface; and terminating the first abrasive stage when the drag force indicates that the cover layer is at least substantially planar at an elevation in the overburden portion of the cover layer.

16. The method of claim 10, further comprising:

sensing a surface condition of the first planarizing surface; and conditioning at least a portion of the first planarizing surface to have the first roughness according to the sensed surface condition of the first planarizing surface.

17. The method of claim 10, further comprising:

sensing a surface condition of the first and second planarizing surfaces;

conditioning at least a portion of the first planarizing surface to have the first roughness according to the sensed condition of the first planarizing surface; and conditioning at least a portion of the second planarizing surface to have the second roughness according to the sensed condition of the second planarizing surface.

18. A method of planarizing a microelectronic workpiece, comprising:

removing material from a microelectronic workpiece during a first abrasive stage of a planarizing cycle by pressing the workpiece against a first planarizing surface having a first roughness and an abrasive slurry on the first planarizing surface;

terminating the first abrasive stage of the planarizing cycle when a cover layer on a face of the workpiece is at least substantially planar at an elevation in an overburden portion of the cover layer;

removing additional material from the workpiece during a second abrasive stage of the planarizing cycle by pressing the workpiece against a second planarizing surface having a second roughness and an abrasive slurry on the second planarizing surface, wherein the first roughness is greater than the second roughness;

commencing the second abrasive stage after terminating the first abrasive stage; and terminating the second abrasive stage of the planarizing cycle at a desired endpoint.

19. The method of claim 18 wherein:

removing material from a microelectronic workpiece comprises providing a first plate and a first planarizing pad on the first plate, the first pad having a surface defining the first planarizing surface; and removing additional material from the workpiece comprises providing a second plate and a second planarizing pad on the second plate, the second pad having a surface defining the second planarizing surface.

20. The method of claim 18 wherein:

removing material from a microelectronic workpiece comprises providing a first planarizing pad having a surface defining the first planarizing surface and conditioning the first planarizing surface to have the first roughness; and removing additional material from the workpiece comprises providing a second planarizing pad having a surface defining the second planarizing surface and conditioning the second surface to have the second roughness.

21. The method of claim 20, further comprising pressing the workpiece against a finishing pad coated with a non-abrasive solution after the second abrasive stage, wherein the finishing pad is separate from the first and second pads.

22. The method of claim 18, further comprising:

sensing a surface condition of the first planarizing surface; and conditioning at least a portion of the first planarizing surface to have the first roughness by adjusting a downforce of a conditioning end-effector according to the sensed surface condition of the first planarizing surface.

23. The method of claim 18, further comprising:

sensing a surface condition of the first and second planarizing surfaces;

conditioning at least a portion of the first planarizing surface to have the first roughness according to the sensed condition of the first planarizing surface; and conditioning at least a portion of the second planarizing surface to have the second roughness according to the sensed condition of the second planarizing surface.

24. A method of planarizing a microelectronic workpiece, comprising:

removing material from a microelectronic workpiece during a first abrasive stage of a planarizing cycle by pressing the workpiece against a first planarizing pad having a first roughness and an abrasive slurry on the first planarizing surface;

determining when the microelectronic workpiece is at least approximately planar, wherein determining planarity comprises monitoring a drag force between the workpiece and the first planarizing pad;

terminating the first abrasive stage when the drag force indicates that a cover layer on a face of the workpiece is at least substantially planar at an elevation in an overburden portion of the cover layer; and removing additional material from the workpiece during a second abrasive stage of the planarizing cycle by pressing the workpiece against a second planarizing pad having a second roughness and an abrasive slurry on the second planarizing surface, wherein the first roughness is greater than the second roughness.

25. The method of claim 24, further comprising:

sensing a surface condition of the first planarizing pad; and conditioning at least a portion of the first planarizing pad to have the first roughness according to the sensed surface condition of the first planarizing pad.

26. The method of claim 24, further comprising:

sensing a surface condition of the first and second planarizing pad;

conditioning at least a portion of the first planarizing pad to have the first roughness according to the sensed condition of the first planarizing pad; and conditioning at least a portion of the second planarizing pad to have the second roughness according to the sensed condition of the second planarizing pad.

27. A method of planarizing a microelectronic workpiece, comprising:

reducing topographical variances across a surface of a microelectronic workpiece during a first abrasive stage of a planarizing cycle by abrading the workpiece against a surface having a first roughness;

terminating the first abrasive stage of the planarizing cycle at an overburden level in a layer of material on the workpiece before the desired endpoint; and removing additional material from a planar surface on the workpiece during a second abrasive stage of the planarizing cycle by abrading the workpiece against a second planarizing surface having a second roughness less than the first roughness.

* * * * *